US005676061A

United States Patent [19]

Loomer

[11] Patent Number: 5,676,061

[45] Date of Patent: Oct. 14, 1997

[54] CARRIER CELL FOR A MONORAIL SORTATION SYSTEM

[75] Inventor: Weston R. Loomer, Walton, Ky.

[73] Assignee: HK Systems, Inc., New Berlin, Wis.

[21] Appl. No.: 629,831

[22] Filed: Apr. 10, 1996

[51] Int. Cl.[6] ..... B61B 13/04

[52] U.S. Cl. ..... 105/141; 104/48; 104/118

[58] Field of Search ..... 104/89, 93, 48, 104/91, 118, 119; 105/141, 144, 148, 150

[56] References Cited

U.S. PATENT DOCUMENTS

| | | | |
|---|---|---|---|
| 3,550,535 | 12/1970 | Rooklyn | 104/118 |
| 3,902,432 | 9/1975 | Shortridge et al. | 104/93 |
| 3,912,071 | 10/1975 | Nielsen | 198/38 |
| 4,480,157 | 10/1984 | Ishikura et al. | 104/93 |
| 4,712,965 | 12/1987 | Canziani | 104/140 |
| 5,213,045 | 5/1993 | Gersemsky | 104/93 |
| 5,235,917 | 8/1993 | Luck et al. | 104/119 |
| 5,303,656 | 4/1994 | Makimura et al. | 104/119 |

*Primary Examiner*—S. Joseph Morano
*Attorney, Agent, or Firm*—Nilles & Nilles, S.C.

[57] ABSTRACT

A carrier cell is provided for use in a high-speed sortation system having an I-beam monorail with vertically spaced upper and lower horizontal plates connected by a web. The carrier cell includes a cover having a horizontally-extending top surface above the rail, and a downwardly extending, tapered side panel with a lower edge which extends adjacent to the lower plate of the rail. A pair of upper wheel assemblies are mounted in the cover. Each upper wheel assembly includes a load wheel mounted for rotation about a horizontal axis to provide driving support for the cell along a top surface of the upper plate, a semi-spherical housing for each load wheel, and a support associated with each housing. The supports are mounted to the upper cover surface and shaped to allow the housings to rotate within the supports. A plurality of upper guide wheels are mounted for rotation about vertical axes in contact with a side of said upper plate. The vertical axes of the guide wheels are connected to the semi-spherical housing such that the housing pivots in response to changes in the position of the guide wheels. At least one lower wheel assembly is mounted to the cover in spaced, vertical relation to the upper wheel assemblies. The lower wheel assembly includes guide wheels which contact a side of the lower plate such that the cell load is counterbalanced between the upper and lower guide wheels as the cell traverses the rail. The upper guide wheels follow the path of the rail to pivot the semi-spherical housing and load wheel within the support, to provide conical steering for the load wheel. The conical steering enables the load wheel to have a natural tendency to travel in a curved path through the turns, thereby eliminating the skidding and friction normally associated with cylindrical load wheels. In addition, the upper and lower guide wheels are positioned to provide three point suspension which enables the carrier cell to tip towards the center of a turn, thereby stabilizing the load on the carrier.

28 Claims, 10 Drawing Sheets

CARRIER CELL FOR A MONORAIL SORTATION SYSTEM

TECHNICAL FIELD

The present invention relates to high-speed sortation systems, and in particular, to a carrier cell for a high-speed sortation system which is mounted on a monorail in a cantilevered position, and in which the attitude of the load bearing wheels varies to provide conical steering for the carrier.

BACKGROUND OF THE INVENTION

Sortation systems are widely used in parcel delivery services, warehouse distribution centers, and numerous other operations as an efficient, convenient and fast way to sort packages or products. In these systems, packages or products may be placed on a conveyor belt or carrier cells and sorted amongst a number of bins or storage locations based upon criteria such as the product's weight, size or destination. The products are typically routed through the sortation system by bar code information stored on the products. A bar code scanner reads in the product information, and from this information the system generates signals to route the product's carrier cell to the proper discharge station. The number of products handled by a sortation system in a typical day can number in the hundreds of thousands. Therefore, it is desirable to have a system that is both fast and reliable, yet causes a minimum amount of product damage.

A number of different sortation systems have been developed which utilize wheeled carrier cells traveling on a monorail track to route products from an induct station to designated discharge stations. Various configurations have been employed in these systems for mounting and moving the carrier cells along the monorail. In a first configuration, the monorail is shaped as a box beam, with a slot extending through the lower edge of the beam to form a pair of flanges. The carrier cell includes a number of load bearing wheels which travel along the flanges of the box beam. The carrier cell extends through the slot between the flanges to support a load suspended beneath the beam.

In a second configuration, the monorail is shaped as an I-beam, and the carrier includes a plurality of load bearing wheels which ride along the upper surface of the lower flange of the I-beam, such that the carrier envelops the lower flange of the beam. In this configuration, the monorail is typically mounted overhead, and the load is supported by the carrier beneath the beam.

In a third configuration, the monorail is again shaped as an I-beam, and the carrier includes a pair of load bearing wheels which travel along the top surface of the I-beam. A plurality of guide wheels having axes of rotation perpendicular to that of the load wheels straddle the monorail and provide lateral support for the carrier. In this configuration, the carrier can include a downwardly extending arm and second set of guide wheels which straddle the lower flange of the I-beam, such that the load is carried under the monorail. In the alternative, the load may be carried on a conveyor or tilt tray mounted on top of the load bearing wheel.

In each of the carrier cell configurations described above, the load bearing wheels are cylindrical and rotate about a central, horizontal axis, such that the wheels, and thus the carrier cell, have a natural tendency to maintain a straight travel path. This natural tendency of the cylindrical load bearing wheels to travel in a straight path produces problems when the carrier cell travels through curves in the monorail. In order for the carrier cell to pass through the curves, the cylindrical load bearing wheels must be pushed off their straight path and around the curve. This forced redirection of the load bearing wheels produces skidding along the monorail, and friction between the wheels and rail. This skidding and friction produces excessive wear on the carrier wheels, resulting in additional maintenance and system downtime. Further, the skidding creates a noisy environment which can be annoying and hazardous to personnel working nearby.

As the volume of products processed by sortation systems continues to increase, there is a need to increase the speed at which the carrier cells traverse the monorail. Increasing the speed of the carrier cells, however, increases the problem of friction and noise during cornering. In addition, higher carrier cell speeds produce instability in loads placed on the cell, particularly during passage through a curve, due to centrifugal forces placed on the load.

Thus, a need exists for a versatile carrier cell for a monorail sortation system which essentially eliminates the skidding and friction, and resulting noise and wear, associated with passage through a curve. Further, it is desirable to have such a carrier cell in which a load conveying mechanism may be readily attached and detached and which can operate at high-speeds while providing stability for the load.

SUMMARY OF THE INVENTION

Accordingly, it is a principal object of the present invention to provide an improved carrier cell for use in a high-speed monorail sortation system.

In particular, it is an object of the present invention to provide a carrier cell for a high speed sortation system in which the attitude of the load bearing wheels varies as the carrier passes through a curve to provide conical steering and essentially eliminate the skidding and friction between the wheels and rail.

Another object of the present invention is to provide a carrier cell which compensates for the centrifugal forces generated by passage of the carrier through curved portions of a monorail, thereby increasing the stability of the carrier load.

Still another object of the present invention is to provide a carrier cell that is easily removed from the monorail, yet is stable and not susceptible to shifting or falling from the monorail during operation.

Yet another object of the present invention is to provide a carrier cell which does not generate noise as it traverses a curve.

A further object of the present invention is to provide an improved carrier cell which requires less power to operate than previous carrier cells.

A still further object of the present invention is to provide a carrier cell which can operate on rails having a wide tolerance range.

Additional objects, advantages and other novel features of the invention will be set forth in part in the description that follows and, in part, will become apparent to those skilled in the art upon examination of the invention. The objects and advantages of the invention may be realized and obtained by means of the instrumentalities and combinations particularly pointed out in the appended claims.

To achieve the foregoing and other objects, and in accordance with the purposes of the present invention as described above, a carrier cell is provided for use in a high-speed sortation system having an I-beam monorail with vertically spaced upper and lower horizontal plates connected by a web. The carrier cell includes a cover having a horizontally-extending top surface above the rail, and a downwardly extending, tapered side panel with a lower edge which extends adjacent to the lower plate of the rail. A pair of upper wheel assemblies are mounted in the cover. Each upper wheel assembly includes a load wheel mounted for rotation about a horizontal axis to provide driving support for the cell along a top surface of the upper plate, a semi-spherical housing for each load wheel, and a support associated with each housing. The supports are mounted to the upper cover surface and shaped to allow the housings to rotate within the supports.

A plurality of upper guide wheels are mounted for rotation about vertical axes in contact with a side of said upper plate. The vertical axes of the guide wheels are connected to the semi-spherical housing such that the housing pivots in response to changes in the position of the guide wheels. At least one lower wheel assembly is mounted to the cover in spaced, vertical relation to the upper wheel assemblies. The lower wheel assembly includes guide wheels which contact a side of the lower plate such that the cell load is counterbalanced between the upper and lower guide wheels as the cell traverses the rail. The upper guide wheels follow the path of the rail to pivot the semi-spherical housing and load wheel within the support, to provide conical steering for the load wheel. The conical steering enables the load wheel to have a natural tendency to travel in a curved path through the turns, thereby eliminating the skidding and friction normally associated with cylindrical load wheels. In addition, the upper and lower guide wheels are positioned to provide three point suspension which enables the carrier cell to tip towards the center of a turn, thereby stabilizing the load on the carrier.

Still other objects of the present invention will become apparent to those skilled in this art from the following description wherein there is shown and described a preferred embodiment of this invention. As will be realized, the invention is capable of other different, obvious aspects all without departing from the invention. Accordingly, the drawings and description should be regarded as illustrative in nature and not as restrictive.

DETAILED DESCRIPTION OF THE PREFERRED EMBODIMENT

Figure 1:
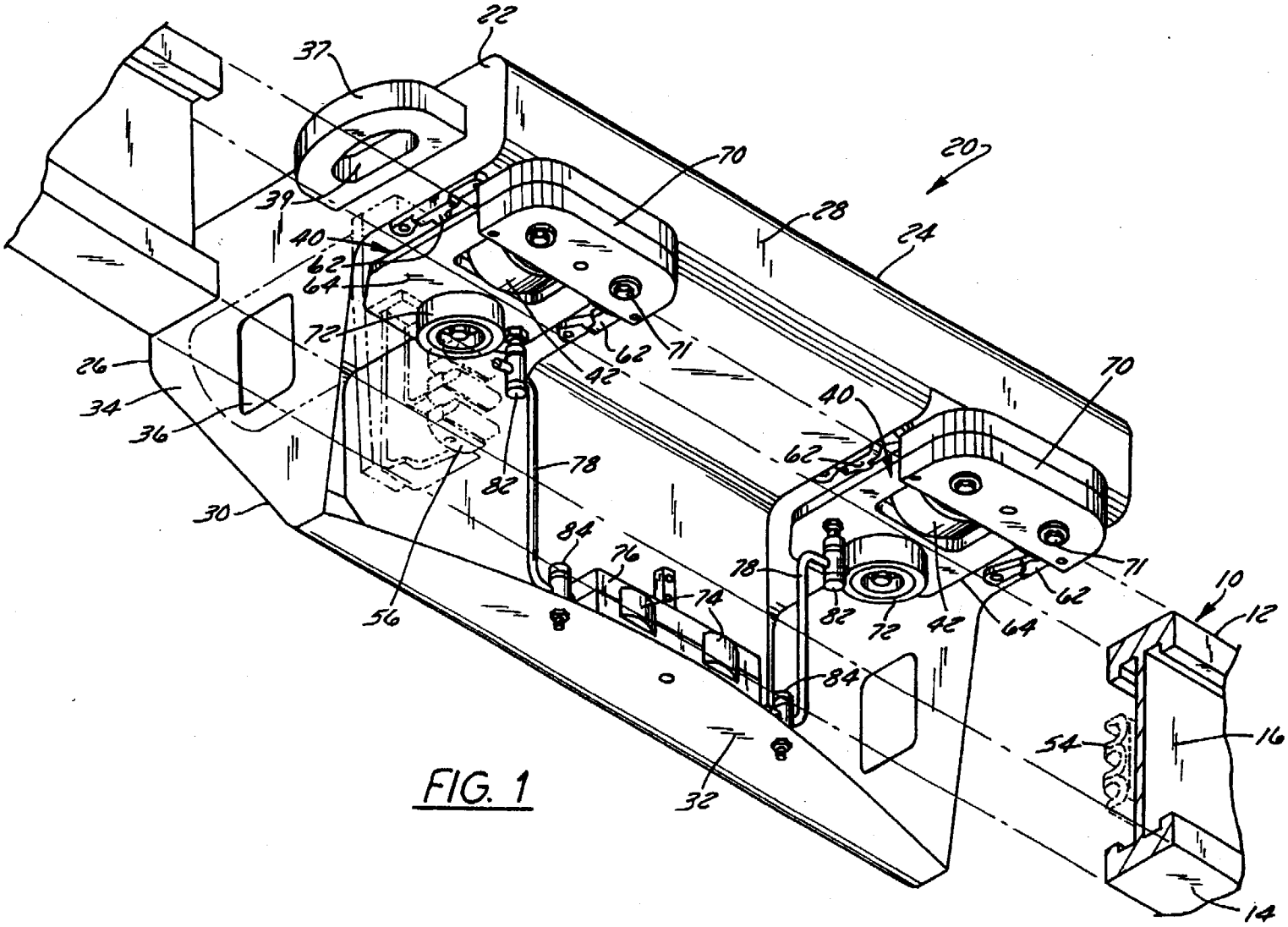
FIG. 1 is a perspective view, taken from below, of a carrier cell of the present invention positioned on an I-beam monorail.

Referring now to the drawings, FIG. 1 illustrates a preferred embodiment of the carrier cell of the present invention mounted on a monorail 10. The monorail has a conventional I-beam construction with an upper plate 12 and a lower plate 14, which are connected by a vertically extending web 16. The monorail 10 is supported in a conventional manner, such as by tubular column supports (not shown) spaced along the rail. The dimensions of the upper plate 12, lower plate 14 and web 16 can vary, with the particular sizes depending upon the application or loads with which the system will be used. The rail 10 may be fabricated from steel or a non-ferrous material. The rail 10 will typically be formed as a closed-loop in order to allow continuous operation of the carrier cells between the loading and discharge stations and, therefore, will include a number of curved portions.

As shown in FIG. 1, the carrier cell of the present invention, designated generally as 20, rides along the top and one side of the rail 10. A cover 22 extends along the top and side of the cell 20. The cover 22 includes a single sheet shaped to form a flat, planar top surface 24 above the rail 10 and a downwardly extending, tapered side panel 26. A vertical overhang 28 extends from the top surface 24 opposite the side panel 26. A lower portion 30 of the side panel 26 tapers inwardly at approximately a 45 degree angle towards the lower plate 14 of the rail 10. A horizontal lip 32 is formed at the lower edge of the side panel 26 so as to lie adjacent to, but just below, the rail 10. The cover 22 is preferably formed from sheet steel or a similar rigid, metallic material. A pair of end panels 34 are bolted to the longitudinal ends of the carrier 20 to partially enclose the carrier. A number of openings 36 may be located in the end and side panels of the cover 22. These openings 36 can be used for positioning controls and communication equipment in the carrier. The precise controls which can be utilized in the carrier are beyond the scope of the present invention and, therefore, further details are not provided.

As shown in FIG. 1, a bumper handle 37 may be provided on either or both of the end panels 34 of the cell. The bumper handle 37 is preferably comprised of a resilient material, such as rubber, to enable the handle to contact adjacent cells on the track without damaging the cells. In addition, an opening 39 is preferably formed in the center of the handle 37 so that the handle can be gripped between an outer edge and the opening in order to lift and carry the cell.

Figure 2:
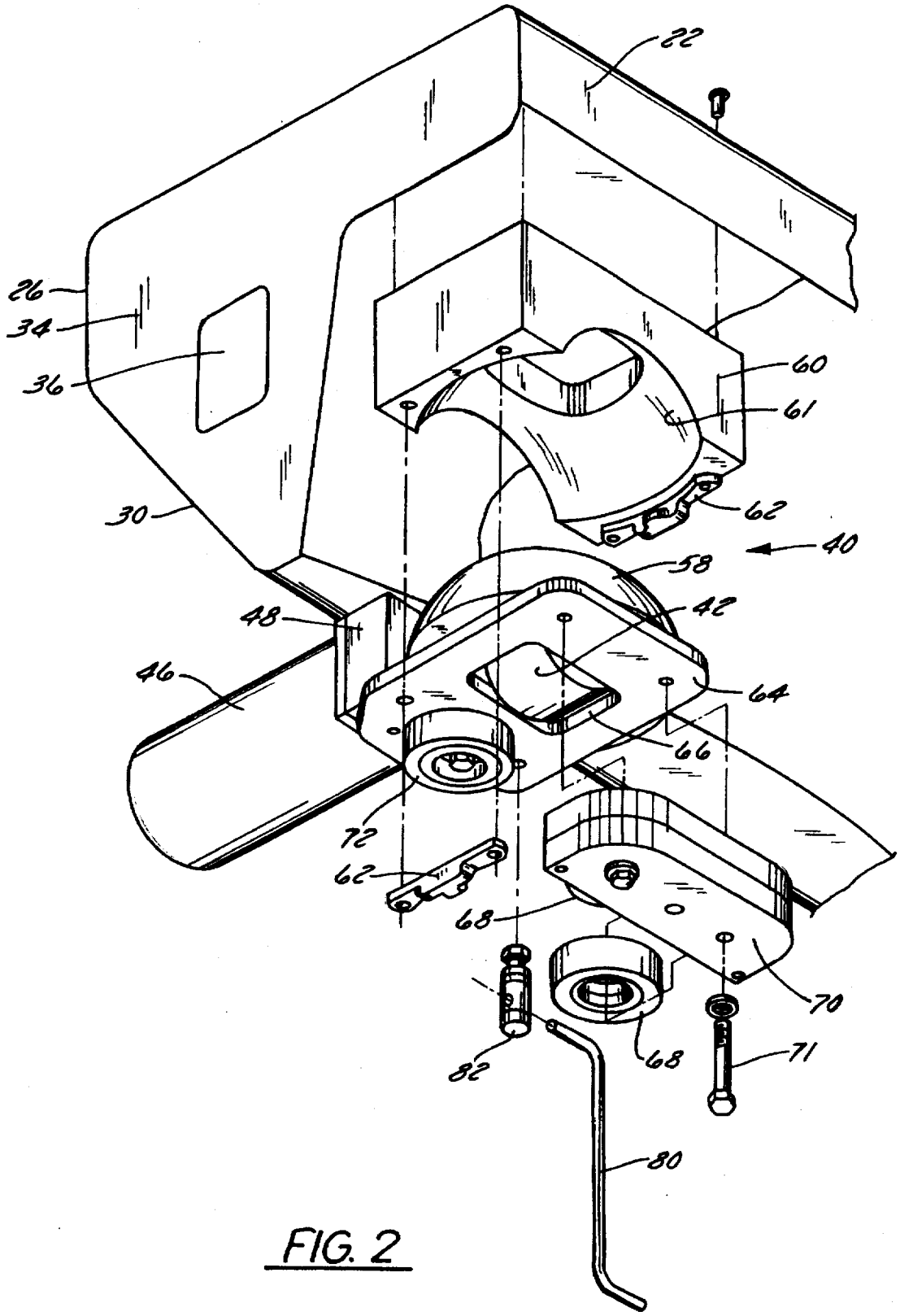
FIG. 2 is a partial, exploded view showing the components which comprise the carrier cell of the invention.
Figure 6:
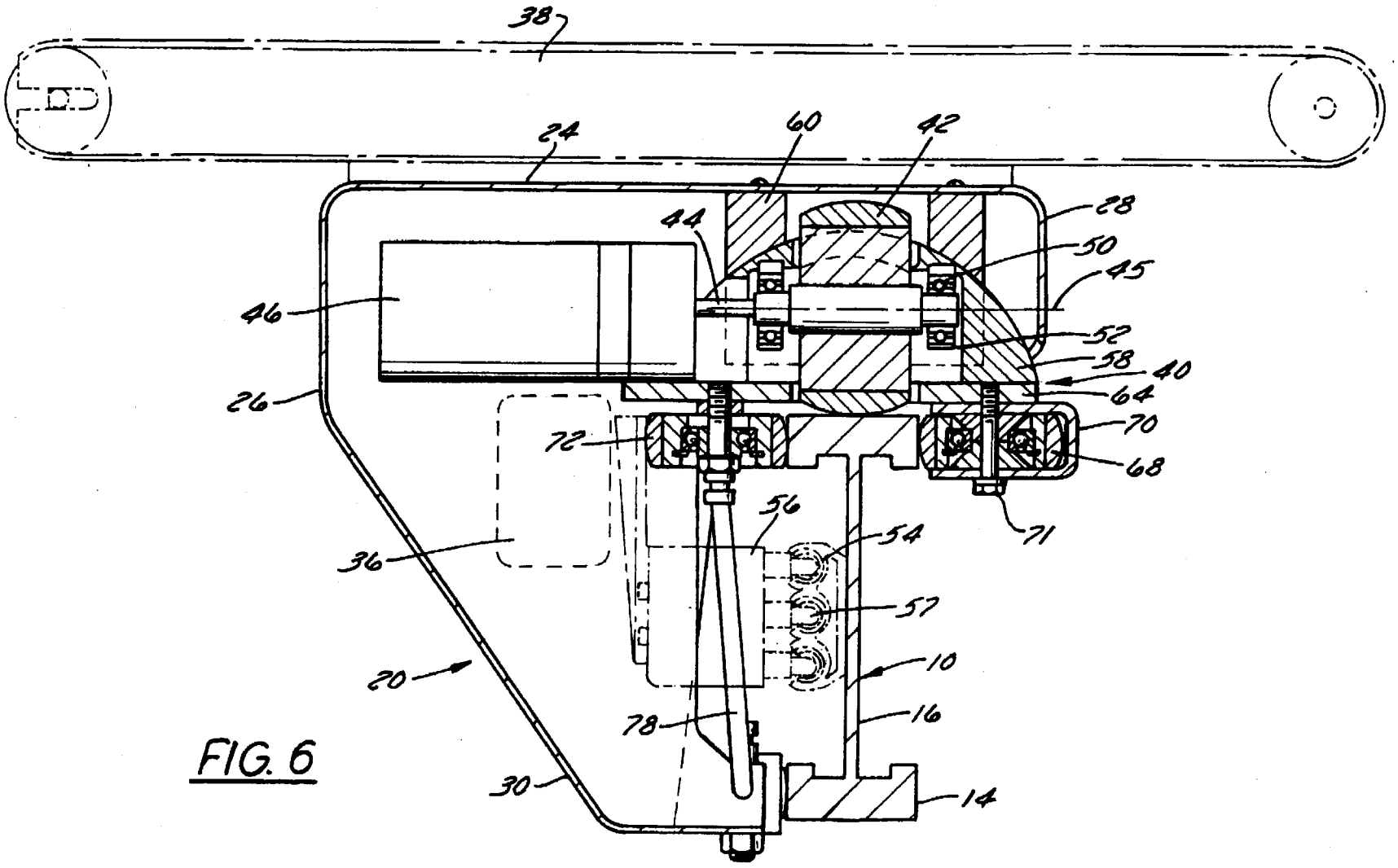
FIG. 6 is a cross-sectional view of the carrier cell and rail taken along line 6—6 of FIG. 3.

As shown in FIGS. 1 and 2, the carrier cell 20 includes a pair of upper wheel assemblies 40. Each of the wheel assemblies 40 includes a cylindrical, crowned, load bearing wheel 42, which rides along the top surface of the rail 10. The load wheel 42 is preferably comprised of a non-metallic material, such as rubber, to reduce the noise and wear on the rail. The load wheel 42 is mounted on a drive shaft 44, shown in FIG. 6, which extends horizontally through the center of the wheel and defines an axis 45. In a preferred embodiment, a motor 46 and gear module 48 are mounted in the carrier cell 20 as part of the wheel assembly 40, and traverse the rail 10 along with the cell. In this embodiment, the motor 46 and gear module 48 are connected to the drive shaft 44 to rotate the load wheel 42 and propel the cell 20 along the rail 10. Bearings 50 shown in FIG. 6, are mounted on the drive shaft 44 on both sides of the load wheel 42, and are retained in bearing supports 52 to enable the load wheel to rotate relative to the assembly 40.

As shown in FIGS. 1 and 6–8, a plurality of buss bars 54 are mounted along the web 16 of the rail 10. The buss bars 54 extend the entire length of the rail 10 and carry power and communication signals for the cells 20. A collector shoe 56 having a plurality of collectors 57 is mounted in the cell 20 so that the collectors slide along the buss bars 54 as the cell traverses the rail 10. The shoe 56 transmits power from the buss bars 54 to the motor 46 for driving the load wheel 42. Communication signals are floated along with the power signals on the buss bars 54, and are intercepted by the shoe 56 and transmitted to a cell control (not shown). The cell control interfaces with the motor 46 to control operation of the cell. In an alternative embodiment, the carrier cell can be used as a driven or idler cell, in which case the carrier cell does not include a motor or gear module, but is instead connected to a second, driver cell, which propels the cell around the track.

As shown in FIG. 2, the wheel assembly 40 includes a semi-spherical housing 58. The crowned load wheel 42 and drive shaft 44 are mounted in the housing 58 such that a portion of the load wheel protrudes from both the planar and spherical faces of the housing. In a driver carrier cell, the drive shaft 44 also extends through the housing 58 to connect with the gear module 48 and motor 46. The spherical surface of the housing 58 is rotatably mounted in a support 60. The support 60 is generally rectangular in shape with a spherical cavity opening 61 on one side. The diameter of the cavity 61 is substantially the same as the spherical housing 58 and clips 62 are secured on opposites sides of the support so as to extend over the planar face of the housing. The clips 62 retain the spherical housing 58 in the support 60 but allow the housing 58 to rotate to the left and right and to tip from side-to-side allowing the load wheel 42 to change attitude relative to the support. The support 60 is mounted to the underside of the top surface of the cover 22 such that the support, housing 58 and load wheel 40 lie directly above the top surface of the rail 10 with the point of contact between the load wheel 42 and the rail 10 being located at the geometric center of the spherical housing 58.

As shown in FIG. 2, a generally rectangular base plate 64 is connected to the planar face of the housing 58. The base plate 64 includes an opening 66 through which the load wheel 42 extends. A pair of guide wheels 68 are located to one side of the load wheel 42, along the outside edge of the cell. The guide wheels 68 are preferably comprised of a non-metallic material, such as rubber, to minimize noise and wear on the rail 10. The guide wheels 68 are mounted in a housing 70 such that a portion of the wheels extends from the housing to contact the side of the rail 10. The guide wheels 68 and housing 70 are attached to the base plate 64 by bolts 71 extending through the center of the wheels. The guide wheels 68 rotate about the bolts 71, perpendicular to the axis of rotation of the load wheel 42. As shown in FIG. 2, an optional secondary support wheel 72 may be mounted on the opposite side of the base plate 64 from the guide wheels 68. The support wheel 72 is preferably comprised of the same material as the guide wheels 68, and is connected for rotation about a vertical bolt, perpendicular to the direction of rotation of the load wheel 42. In operation, the cell 20 is cantilevered on the rail 10 such that secondary wheel 72 is not normally in contact with the rail. However, the support wheel 72 may be provided as security against unintentional shifting of the guide wheels 68 away from the rail.

As shown in FIG. 1, a set of lower guide wheels 74 are attached to the lower lip 32 of the cover 22 in contact with the bottom plate 14 of the rail. The lower guide wheels 74 are preferably comprised of the same material as the upper guide wheels 68, and are mounted within a housing 76 so as to rotate about vertical axes extending through the center of the wheels. A portion of each wheel 74 extends from the housing 76 to contact the lower plate 14 of the rail 10. When mounted on the rail 10, the lower guide wheels 74 support the cell 20 against and travel along the side of the lower plate 14. In a preferred embodiment, the lower guide wheels 74 are centered longitudinally between the wheel assemblies 40 as shown in FIGS. 1 and 3–5. While the invention is described with respect to a pair of lower guide wheels which are closely spaced between the upper wheel assemblies 40, it is to be understood that it is possible to utilize only a single lower guide wheel, centered between the upper wheel assemblies 40, without departing from the scope of the invention. In addition, the spacing between the lower guide wheels 74 can be varied in order to vary the tip of the cell 20, as will be described in more detail below, without departing from the scope of the invention.

As shown in FIGS. 1 and 2, steering linkages 78 may be provided between the upper wheel assemblies 40 and the lower edge 32 of the carrier cell 20. The linkages 78 include a crank-shaped rigid portion 80 extending between a pair of swivel joints 82, 84. The first swivel joint 82 is attached to the base plate 64 on the opposite side of the guide wheel housing 70, while the second swivel joint 84 is attached to the lower edge 32 of the cover 22, adjacent to the lower guide wheel housing 76. The linkages 78 control the attitude of the upper wheel assemblies 40 in response to the lateral movement of the lower edge of the cell 20, as will be described in more detail below.

As shown in FIGS. 1 and 6–8, the wheel assemblies 40 are mounted to one side of the cell 20, and the body of the cell is cantilevered with respect to the rail 10, such that the bulk of the cell and load are positioned to the side of the rail. This cantilevered position offsets the center of gravity of the cell and produces an eccentric load on the rail. The cell 20 is supported in this cantilevered position by the upper and lower guide wheels 68, 74. The upper guide wheels 68 contact and travel along the outer side of the upper plate 12 of the rail, and counteract the moment of the cell and load against this side of the rail. The force applied against the rail by the upper guide wheels 68 is counterbalanced by the lower guide wheels 74, which contact and apply an opposing force against the inner side of the lower plate 14. The distribution of the weight of the cell between the upper and lower plates 12, 14 of the rail 10 counterbalances and, thus, stabilizes the cell 20 on the rail.

Figure 3:
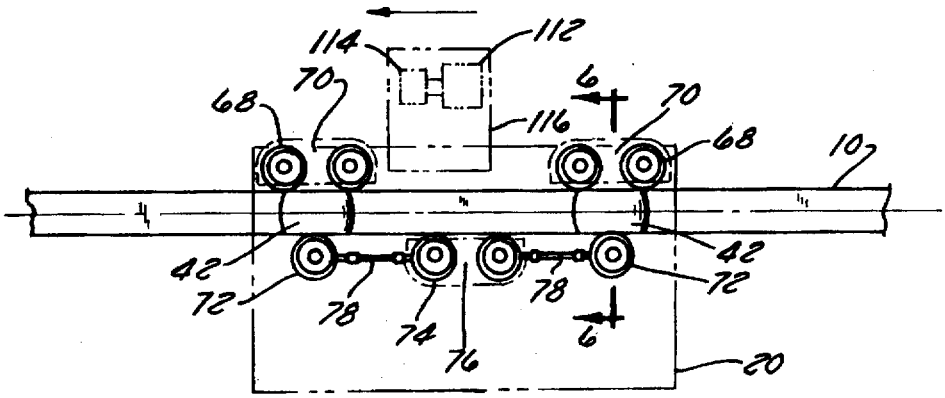
FIG. 3 is a top view of the carrier cell of FIG. 1, depicting the position of the carrier cell wheels as the cell traverses a straight path.

As described above, a pair of upper wheel assemblies 40 are mounted along a side edge of the carrier cell 20. Each of the wheel assemblies 40 includes a load wheel 42 which travels along the top surface of the rail, and a pair of guide wheels 68 which travel along the outer side of the rail. Each of the load wheels 42 and pairs of guide wheels 68 are attached to a spherical housing 58 which rotates within a support 60. The rotation of the housing 58 within the support 60 enables the wheels 42 and 68 to rotate or change attitude relative to the support and cover 22. As shown in FIGS. 3 and 6, as the carrier cell 20 traverses a straight section of the rail 10, the upper and lower guide wheels 68, 74 travel along the sides of the rail, and the load wheels 42 travel along the top surface of the rail to support the cell. In this straight section of track, the load wheels 42 are positioned on the rail such that the axis 45 of each wheel is parallel to the top surface of the rail 10. In addition, the guide wheel housings 70 are parallel to the track. Since the center points of the crowned load wheels 42 are in contact with the rail 10, the wheels have a natural tendency to travel in a straight path along the rail.

Figure 7:
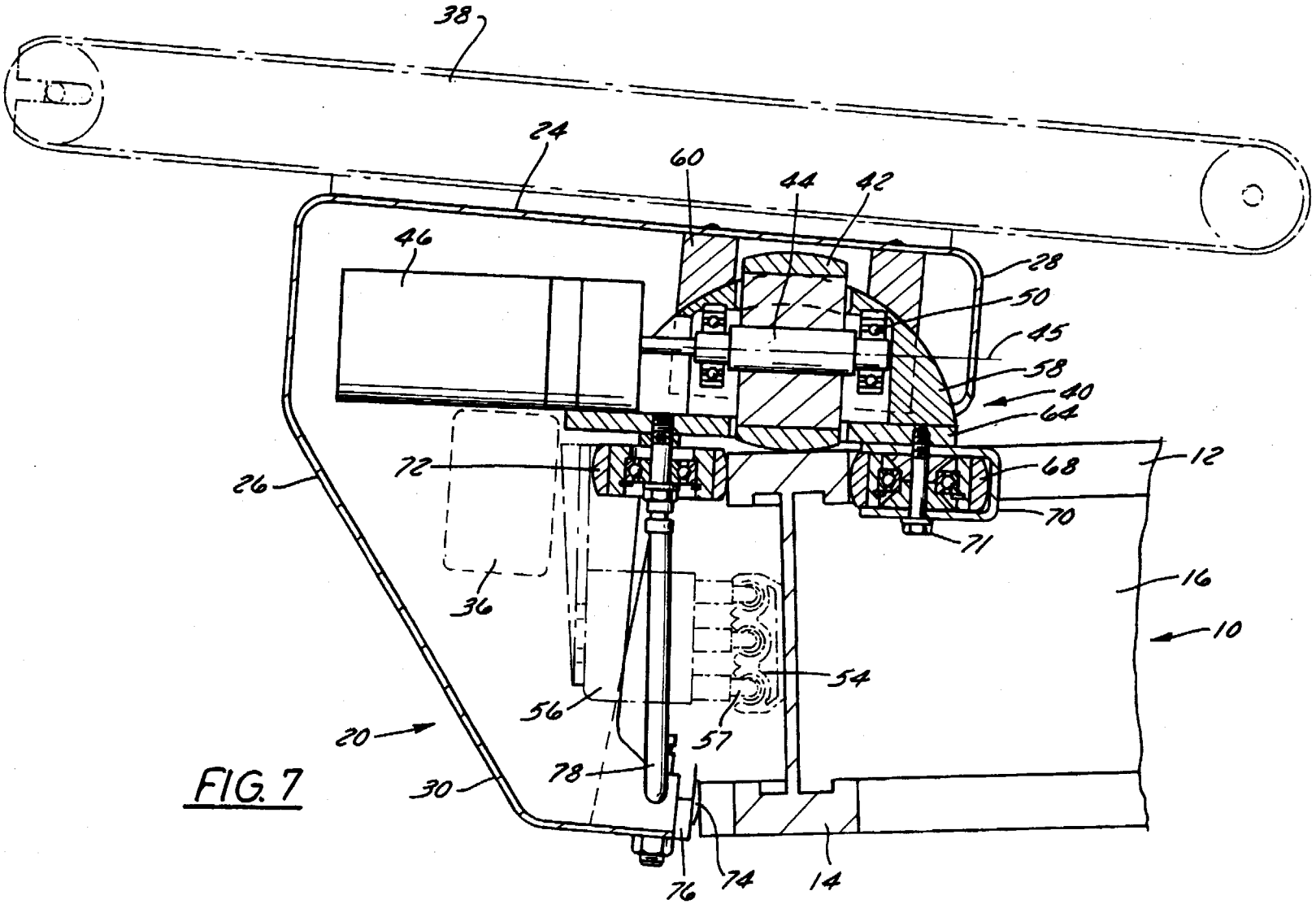
FIG. 7 is a cross-sectional view of the carrier cell and rail taken along line 7—7 of FIG. 4.
Figure 11:
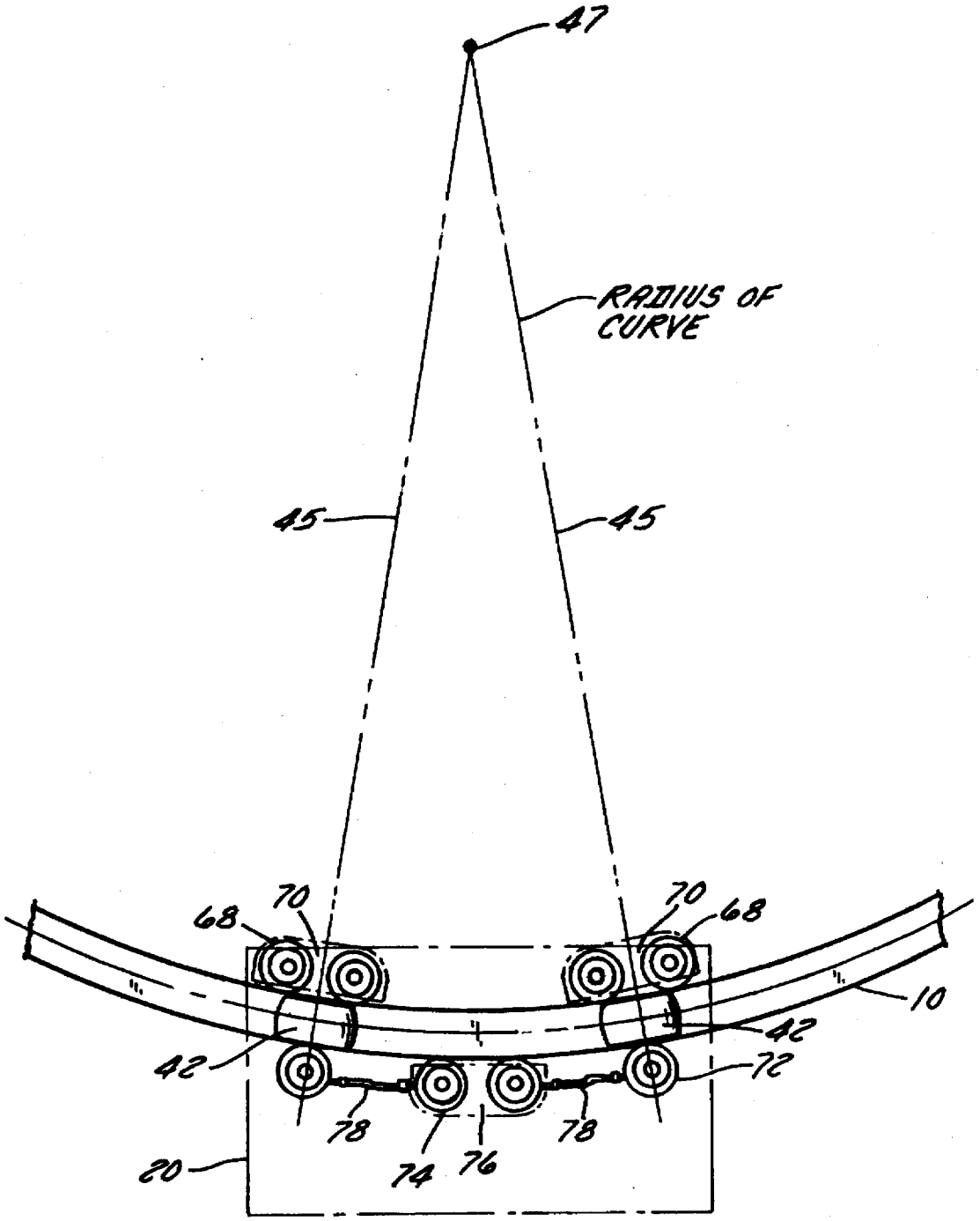
FIGS. 11 and 12 show the change in attitude of the load wheel in a curve.
Figure 12:
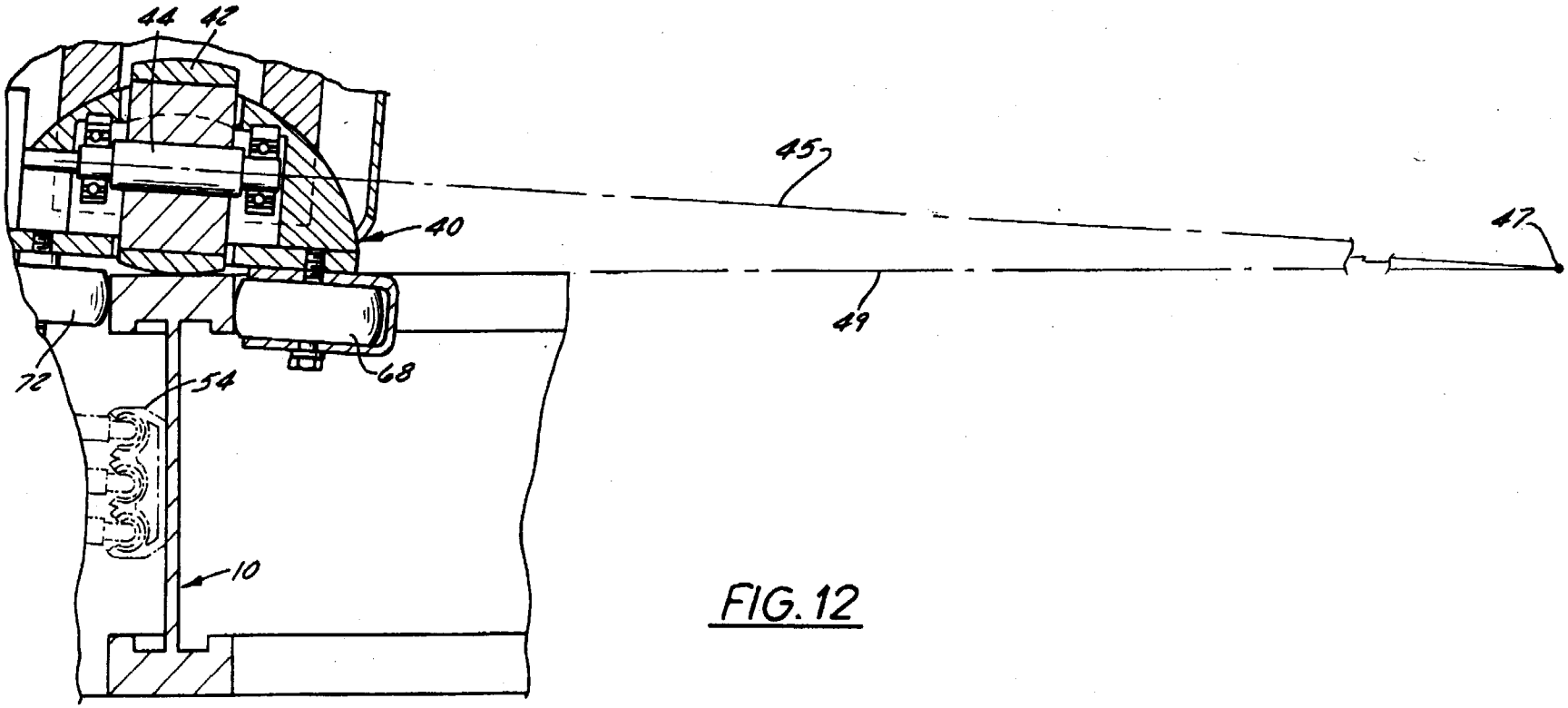

As shown in FIGS. 4, 7, 11, and 12, when the cell 20 approaches a right turn in the rail, the upper guide wheels 68 remain in contact with the rail 10 and follow the path of the rail, causing the spherical housings 58, to which the guide wheels are attached, to rotate within the supports 60. Because the load wheels 42 are mounted within the housings 58, they rotate with the housings, changing the attitude of the wheels on the rail. As the load wheels 42 rotate, the axis 45 through the center of the wheels shifts, as shown in FIGS. 7, 11 and 12, so that the axis 45 intersects a plane 49 which includes the top surface of the rail 10, at a point 47 which is located at a distance from the rail which is approximately equal to the radius of the curve of the rail. The point of contact between each load wheel 42 and the rail 10 also shifts so that a side, angled portion of the wheel rides the rail. This side portion of the wheel 42 has a natural tendency to travel in a curved path, as if the wheel were conical rather than cylindrical in shape, with the vertex of the cone being located at point 47, the center of the curve. Thus, the load wheels 42 traverse the curve on a curved rather than a straight path.

Figure 5:
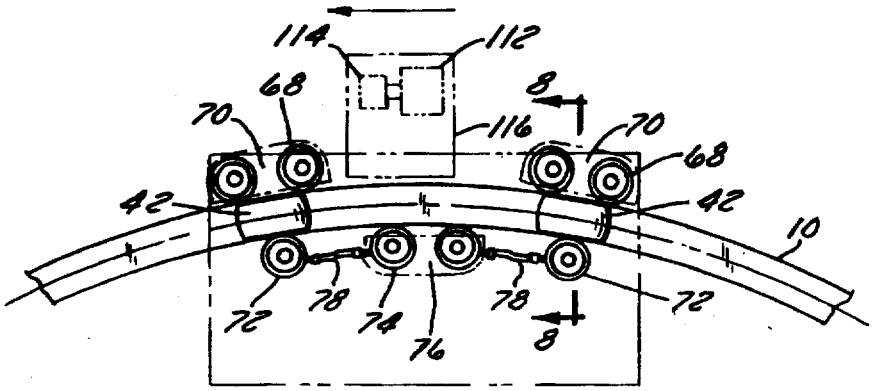
FIG. 5 is a top view of the carrier cell of FIG. 1, depicting the position of the carrier cell wheels as the cell traverses a left-hand curve.
Figure 8:
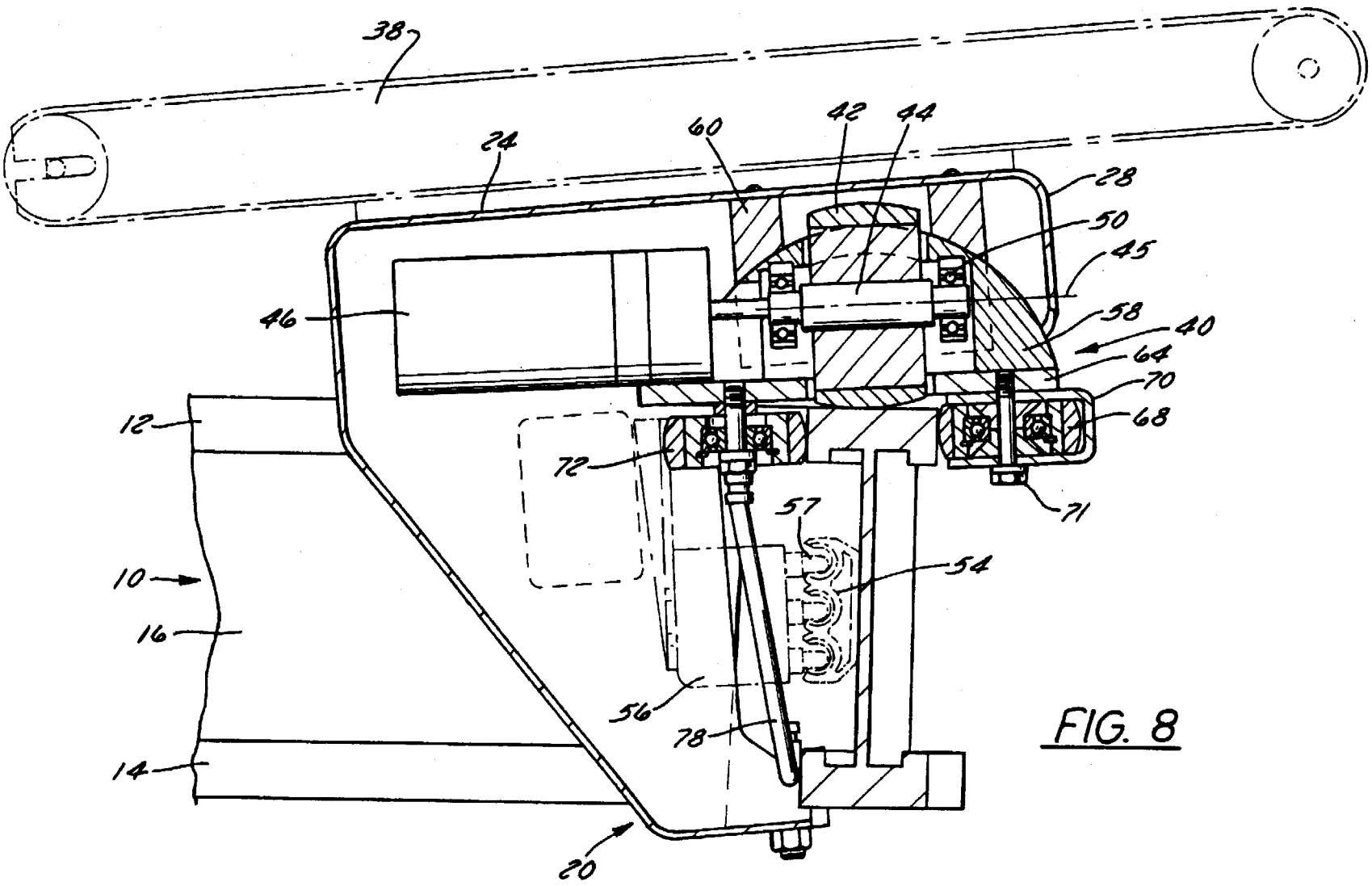
FIG. 8 is a cross-sectional view of the carrier cell and rail taken along line 8—8 of FIG. 5.

As shown in FIGS. 5 and 8, when the cell 20 traverses a left turn, the guide wheels 68 again follow the path of the curve, resulting in the spherical housings 58 and, thus, the load wheels 42 rotating within the supports 60 to change attitude in the opposite direction. This rotation results in the axis 45 of the load wheel shifting from horizontal so that the opposite, angled side portion of the wheels contact and travel along the rail. This shifting of the axis of the wheels causes the wheels to have a natural tendency to follow a curved path in the opposite direction, enabling the load wheels and cell to smoothly follow the curve.

Accordingly, in the present invention the load wheels are mounted in a spherical housing in the cell which enables the load wheels to change attitude as the cell traverses a curve. Changing the attitude of the crowned load wheels enables the wheels to travel as if shaped like a cone, which has a natural tendency to travel in a curved path, rather than in a conventional, straight cylindrical wheel path. Thus, the load wheels are able to traverse the curve smoothly, without the skidding, friction and noise that normally accompanies cylindrical load wheels.

Figure 4:
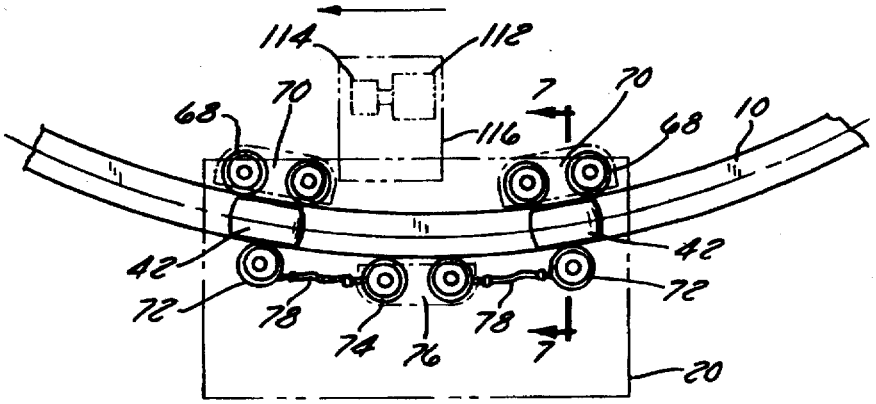
FIG. 4 is a top view of the carrier cell of FIG. 1, depicting the position of the carrier cell wheels as the cell traverses a right-hand curve.

As described above, in a preferred embodiment of the invention a pair of lower guide wheels 74 are provided to support the cell 20 along the lower rail and counterbalance the upper guide wheels. As shown in FIGS. 4 and 7, as the cell 20 enters a curve, the lower guide wheels 74, and thus the lower edge 32 of the cell, closely follow the rail, due to the closely-spaced, centered position of the wheels 74. Because the upper guide wheel assemblies 70 are spaced apart, the upper portion of the cell does not follow the curve as closely as the lower guide wheels 74 and remains spaced from the curve, similar to a chord subtending an arc. This spacing of the top portion of the cell away from the curve, while the lower portion closely follows the curve, causes the cell to tip or bank towards the center of the curve. FIG. 7 shows the carrier cell banking as it traverses a right turn, while FIG. 8 shows the carrier cell banking as it traverses a left turn. This banking of the cell offsets some of the centrifugal forces placed on the cell and load in the curve, thereby increasing the stability of the load. It should be noted that while the invention has been described with respect to a pair of closely spaced lower guide wheels, it is possible to achieve the benefits of the present invention with only a single lower guide wheel. Accordingly, the number and position of the lower guide wheels may be varied without departing from the scope of the invention.

In some applications, it may not be desirable to have the carrier cell bank on turns. Accordingly, the banking can be eliminated by spacing the lower guide wheels apart, so that the longitudinal spacing of the lower guide wheels is equivalent to the spacing between the upper wheel assemblies 40. Likewise, the angle at which the carrier cell banks in a turn can be varied by varying the spacing between the lower guide wheels 74. The wheels can be varied from being spaced close together which provides optimum banking, to being spaced at opposite ends of the carrier, which essentially eliminates banking.

As described above, a steering linkage 78 may be provided in the carrier cell 20 to interconnect the upper wheel assemblies 40 and lower edge 32 of the cell to control the attitude of the wheel assemblies as a function of the pivoting of the wheel assemblies. As shown in FIG. 3, when the carrier traverses a straight path, the upper wheel assemblies 40 are maintained in a straight path and the linkages 78 do not effect the position of the load and upper guide wheels. However, as shown in FIG. 4, when the cell enters a turn and the lower edge of the cell moves laterally with respect to the upper portion of the cell to bank the cell, the linkages 78 exert a force on the base plates 64 of the wheel assemblies 40. This force controls the attitude of the load wheels 42 with respect to the banking of the carrier, so that the wheels bank less than they otherwise would for the mount of banking in the cell.

Figure 9:
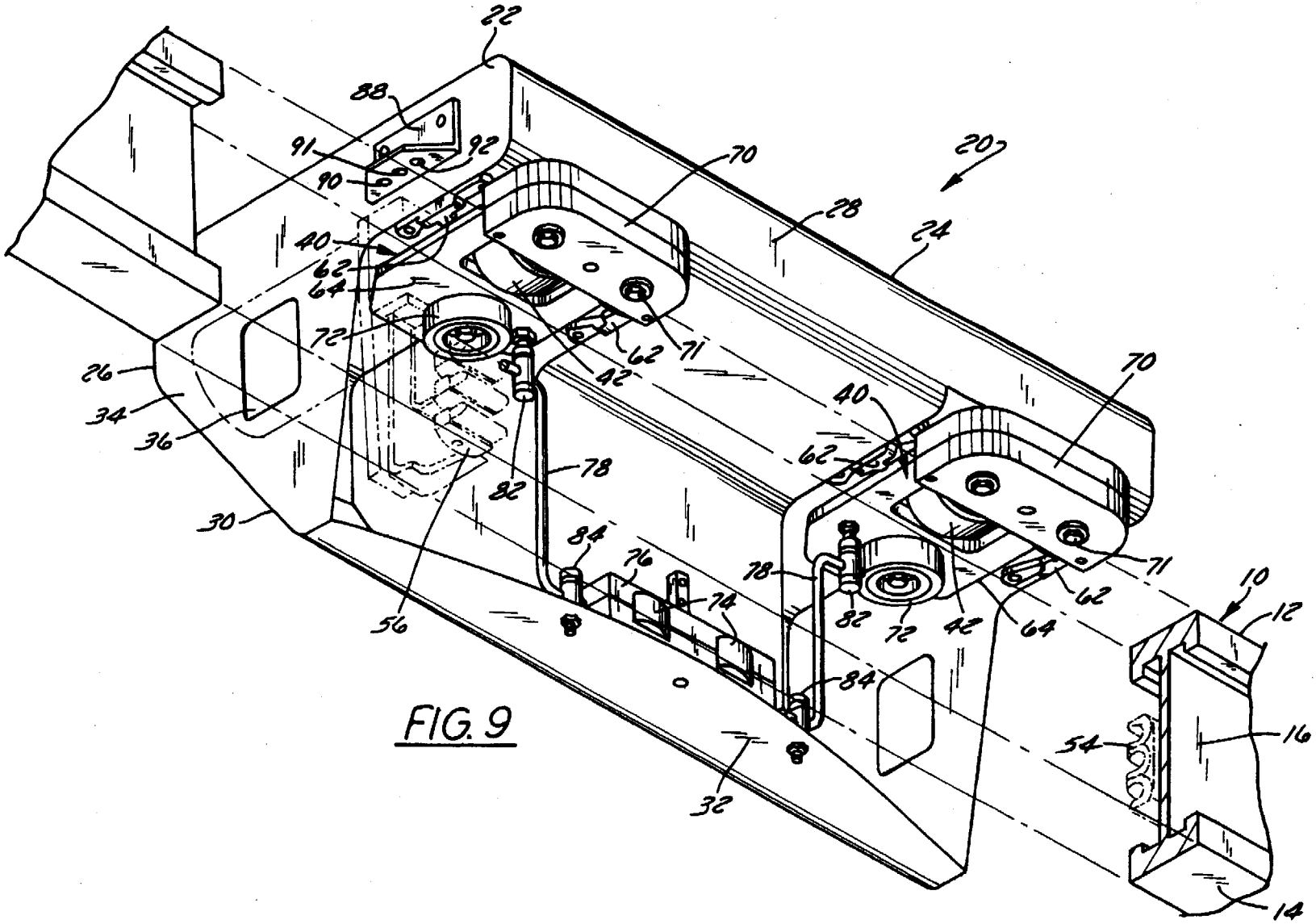
FIG. 9 is a perspective view of the carrier cell of FIG. 1 modified to include a bracket for connecting adjacent cells.

The carrier cells 20 may be used singly or in trains. When a train configuration is desired, a bracket 88, such as shown in FIG. 9, is mounted on both ends of each cell for use in coupling the cells together. Each bracket 88 is centered over the rail 10 and has three holes 90–92 which receive the end of a linkage member (not shown) to couple the cells together. Ordinarily the center hole 91 of the bracket is used. When a train of cells fills the entire loop of a rail track, the linkage may be kept as short as possible to maximize the number of cells in the train. In the event that the shortness of the linkage causes the inside corner of the cells to interfere with one another when the cells traverse a curve, the hole on the bracket which is nearest the inside corner may receive the end of the linkage member in order to relieve the interference.

Figure 10:
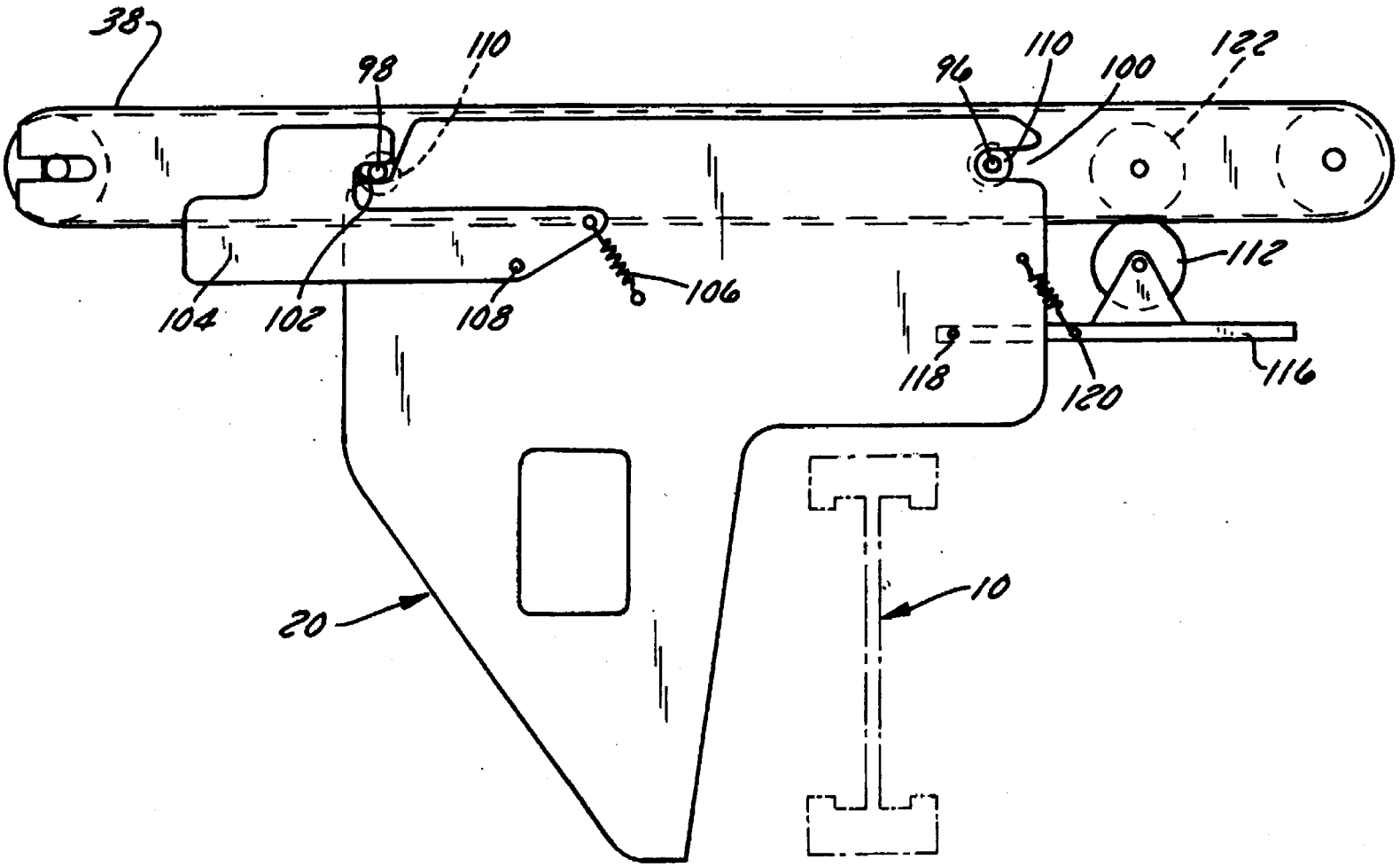
FIG. 10 is an end view of the cell of FIG. 1 depicting the operative mechanisms for the belt conveyor.

In a preferred embodiment of the invention, a belt conveyor 38, shown in FIGS. 6–8, is located on the top surface 24 of the cell. The cell load travels on this belt conveyor 38. The conveyor 38 rotates perpendicular to the direction of travel of the cell 20 to discharge the load from the cell. FIG. 10 illustrates a preferred mechanism for connecting the belt conveyor 38 to the carrier cell. As shown in FIG. 10, the conveyor 38 may include pins 96, 98 extending from the sides of the conveyor. To assemble the conveyor on the cell, pin 96 is slid into a slot 100 formed in the front of the cell cover 22. Pin 98 is then swung into a notch 102 formed in the back of the cover 22. A lever 104 pivots by means of a spring 106 and pin 108 to catch and hold pin 98 in notch 102. Bevel washers 110 are located on pins 96, 98 to help center the conveyor on the cell. To remove the conveyor 38 from the cell, the back edge of the lever 104 is depressed, to pivot the lever about pin 108 and open notch 102 to release pin 98 upward.

A drive roller 112 is provided for operating the conveyor. Drive roller 112 is rotated by a motor 114, which is mounted alongside the roller on a motor support 116. Motor support 116 is held in place by a pivot pin 118 attached to the frame of the cell. Pivot pin 118 enables the drive roller 112 and motor 114 to pivot on the support relative to the cell. To operate the conveyor, driver roller 112 is biased against the conveyor belt by a spring 120. A pinch roller 122 is positioned on the opposite side of the belt, such that the belt is pinned between the drive and pinch rollers 112, 122 so as to rotate with the drive roller.

While the invention is described with respect to a conveyor belt for discharging the load, it is to be understood that other means, such as a tilt tray, or a fixed tray or platform could be utilized for conveying and discharging a load from the cell without departing from the scope of the invention. The load may also be carried by a means which is suspended from the cell to a position which is below the rail 10.

Accordingly, the present invention provides a carrier cell in which the attitude of the load wheels changes in correspondence with the path of the rail to effectively provide conical steering of the carrier. In the present invention, the natural path of the load wheels is redirected from a straight, cylindrical path to a curved, conical path through curves in the rail, thereby enabling the carrier cell of the present invention to pass through the curves without skidding and friction, and the resulting noise and wheel damage. Because the load wheels traverse the curve in a smooth arc, rather than being pushed through the curve as with conventional cylindrical wheels, the cell of the present invention requires less power to operate and provides a smoother, quieter passage along the track. Further, in the present invention the guide wheels are positioned so as to provide three point suspension which allows the carrier cell to bank within a curve. The banking of the cell towards the center of the curve helps stabilize the load against the centrifugal forces applied in the curve. In addition, because the cell is supported on the rail by vertically spaced guide wheels, the width of the upper and lower plates does not have to be closely controlled. This is an improvement over conventional carrier cells having guide wheels which straddle the rail. In these conventional carriers, if the width of the rail varies, as is often the case through a curve, the guide wheels would be either too close to the rail resulting in rubbing, friction and difficulty turning, or would be spaced too far from the rail causing the cell to be unstable on the rail.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described in order to best illustrate the principles of the invention and its practical application to thereby enable one of ordinary skiff in the art to best utilize the invention in various embodiments and with various modifications as are suited to the particular use contemplated. It is intended that the scope of the invention be defined by the claims appended hereto.

What is claimed is:

1. A carrier cell for travel along a rail, said carrier cell comprising:

a cover;

a plurality of load wheels horizontally spaced within said cover, each of said load wheels being rotatable to move said carrier cell along a straight section of said rail, and each of said load wheels also being steerable and tiltable to move said carrier cell along a curved section of said rail;

a plurality of upper guide wheels, said upper guide wheels being positioned adjacent said load wheels so as to engage a side surface of said rail; and at least one lower guide wheel mounted in spaced vertical relation to said upper guide wheels, said at least one lower guide wheel contacting a side surface of said rail.

2. A carrier cell as recited in claim 1 wherein said upper and lower guide wheels contact opposite sides of said rail.

3. A carrier cell as recited in claim 2 wherein said upper and lower guide wheels counterbalance said carrier on said rail.

4. A carrier cell as recited in claim 3 wherein said upper guide wheels are mounted for rotation about vertical axes.

5. A carrier cell as recited in claim 1, wherein said plurality of load wheels traverse curved sections of said rail as if shaped like a cone.

6. A carrier cell for a sortation system having an I-beam rail with vertically spaced upper and lower horizontal plates connected by a web, said carrier cell comprising:

a cover;

a pair of load wheels horizontally spaced within said cover, each of said load wheels being mounted for rotation about a horizontal axis to move said carrier cell along a top surface of said upper plate;

a plurality of upper guide wheels, said upper guide wheels being positioned adjacent said load wheels so as to engage a side of said upper plate;

means mounted in said cover for changing the attitude of said load wheels relative to said I-beam rail, said attitude changing means including semi-spherical housing and support means, said load wheels being mounted within said housing means for steering and tilting within said support means; and at least one lower guide wheel mounted in spaced vertical relation to said upper guide wheels, said at least one lower guide wheel contacting a side of said lower plate;

and wherein said upper and lower guide wheels contact opposite sides of said rail and counterbalance said carrier on said rail, and wherein said upper guide wheels are mounted for rotation about vertical axes.

7. A carrier cell as recited in claim 6 wherein movement between said semi-spherical housing and support means steers and tilts said load wheels.

8. A carrier cell as recited in claim 7 wherein said upper guide wheels are attached to said housing means such that said guide wheels move said housing means with respect to said support means as said guide wheels traverse said rail.

9. A carrier cell as recited in claim 6 wherein said at least one lower guide wheel is centered between said load wheels.

10. A carrier cell as recited in claim 9 wherein said at least one lower guide wheel includes two lower guide wheels.

11. A carrier cell as recited in claim 9 wherein said load wheels are mounted in separate housing means.

12. A carrier cell as recited in claim 11 wherein said load wheels steer and tilt independently of one another.

13. A carrier cell as recited in claim 12 wherein at least one of said load wheels is mounted on a drive shaft within said housing means.

14. A carrier cell as recited in claim 13 further comprising a motor for rotating one of said load wheels, said drive shaft extending from said housing means to said motor for driving said load wheel.

15. A carrier cell for travel along a rail, said cell comprising:

a cover, said cover including an upper planar surface above said rail, and a vertically-extending side, said side including a tapered lower portion terminating adjacent said lower plate of said rail;

a plurality of upper wheel assemblies, said assemblies being mounted in said cover between said upper surface and said rail, for supporting said cell on said rail;

a semi-spherical support which steers and tilts said wheel assemblies in response to changes in a path of said rail; and at least one lower guide wheel mounted adjacent a lower edge of said cover, said lower guide wheel contacting said lower plate of said rail.

16. A carrier cell as recited in claim 15 wherein further comprising steering means for controlling the steering and tilting of said wheel assemblies.

17. A carrier cell as recited in claim 15 wherein said upper wheel assemblies are longitudinally spaced within said cell, and said at least one lower guide wheel is centered between said wheel assemblies.

18. A carrier cell for travel along a rail having an upper plate and a lower plate connected by a vertically extending web, said cell comprising:

a cover, said cover including an upper planar surface above said rail, and a vertically-extending side, said side including a tapered lower portion terminating adjacent said lower plate of said rail;

a pair of upper wheel assemblies, said assemblies being mounted in said cover between said upper surface and said rail, for supporting said cell on said rail;

support means for steering and tilting said wheel assemblies in response to changes in a path of said rail;

at least one lower guide wheel mounted adjacent a lower edge of said cover, said lower guide wheel contacting said lower plate of said rail; and steering means for controlling steering of said wheel assemblies, said steering means including a linkage extending between said wheel assemblies and said housing lower edge.

19. A carrier cell as recited in claim 18 wherein said upper wheel assemblies include a load wheel and a plurality of upper guide wheels, said load wheel being rotatable about a horizontal axis along said top surface of said rail and said guide wheels being rotatable about a vertical axis along a side of said upper plate.

20. A carrier cell as recited in claim 19 wherein the center of gravity of said cell is to a side of said rail and wherein said cell exerts an eccentric load on said rail.

21. A carrier cell as recited in claim 20 wherein said upper guide wheels contact a first side of said upper plate and said lower guide wheels contact an opposite side of said lower plate to counterbalance said cell on said rail.

22. A carrier cell as recited in claim 21 wherein said at least one lower guide wheel includes two lower guide wheels.

23. A carrier cell as recited in claim 22 wherein the spacing between said lower guide wheels can be varied to vary the degree of tilt of said carrier cell.

24. A carrier cell for a sortation system having an I-beam rail with vertically spaced upper and lower horizontal plates connected by a web, said carrier cell comprising:

a plurality of load wheels horizontally spaced within said cell, each of said load wheels being mounted for rotation about a horizontal axis to provide driving support for said cell along a top surface of said upper plate;

a plurality of upper guide wheels, positioned adjacent to said load wheels, said upper guide wheels being mounted for rotation about a vertical axis in contact with a side of said upper plate; and a semi-spherical support which steers and tilts said load wheels, and which tilts said upper guide wheels, in response to changes in a path of said rail; and at least one lower guide wheel mounted in spaced vertical relation to said upper guide wheels, said at least one lower guide wheel contacting said lower plate on a side opposite said upper guide wheels.

25. A carrier cell for a sortation system having an I-beam rail with vertically spaced upper and lower horizontal plates connected by a web, said carrier cell comprising:

a cover, said cover including an upper, horizontally-extending surface above said rail, and a downwardly extending, tapered side panel, a lower edge of said side panel lying adjacent to said lower plate of said rail;

a pair of load wheels horizontally spaced within said cover, each of said load wheels being mounted for rotation about a horizontal axis to provide driving support for said cell along a top surface of said upper plate;

semi-spherical housings for said load wheels, said load wheels being mounted within said housings such that said wheel axes extend parallel to a plane of said housing;

a support associated with each housing, said support being mounted to said upper cover surface, said housings being rotatable within said supports;

a plurality of upper guide wheels, said upper guide wheels mounted for rotation about vertical axes in contact with a side of said upper plate; said vertical axes being connected to said semi-spherical housings such that said housings pivot in response to changes in position of said guide wheels; and at least one lower guide wheel mounted in spaced vertical relation to said upper guide wheels, said at least one lower guide wheel contacting a side of said lower plate whereby the load of said carrier is counterbalanced between said upper and lower guide wheels as said cell traverses said rail.

26. A material handling system for transporting a plurality of discrete packages to any of a number of remote locations, said system comprising:

a rail, said rail including upper and lower horizontal plates connected by a vertically extending web;

a plurality of bus lines attached to and extending along said rail between said upper and lower plates; and at least one carrier cell, said carrier cell including, a cover, said cover including an upper planar surface extending above said rail, and a vertically-extending side panel, said side panel including a tapered lower portion terminating adjacent said lower plate of said rail;

a plurality of load wheel assemblies, said assemblies mounted in said cover between said upper surface and said rail, said assemblies including a load wheel mounted for rotation along a top surface of said rail;

motor means mounted in said carrier for rotating said load wheels;

collector means mounted in said cover for transferring power from said bus lines to said motor;

spherical support means for steering and tilting said wheel assemblies in response to changes in the path of said rail; and at least one lower guide wheel mounted adjacent a lower edge of said side panel, said lower guide wheel mounted for travel along said lower plate.

27. A carrier cell for travel along a rail, said carrier cell comprising

A. first and second wheel assemblies, each of said first and second wheel assemblies including 1. a load wheel, said load wheel being rotatable to move said carrier cell along a top surface of said rail,
2. a plurality of guide wheels, each of said plurality of guide wheels engaging a side surface of said rail, and
3. a housing which mounts said load wheel and said plurality of guide wheels to the remainder of said carrier cell, said housing permitting said wheel assembly to be steerable and tiltable with respect to the remainder of said carrier cell;

B. a third wheel assembly having at least one additional guide wheel which engages a side surface of said rail;

C. first and second steering linkages, said first and second steering linkages respectively coupling said housing to said first and second wheel assemblies, and said first and second steering linkages respectively controlling the steering of said first and second wheel assemblies when said carrier cell enters a curved section of said rail such that each of said load wheels traverses said curved section as if shaped like a cone.

28. A carrier cell comprising:

a wheel assembly, said wheel assembly including a load wheel, said load wheel being rotatable to move said carrier cell along a top surface of a rail, and a semi-spherical housing; and a support for said wheel assembly, said support having a semi-spherical cavity formed therein which engages said semi-spherical housing and which mounts said wheel assembly to said carrier cell;

and wherein said semi-spherical housing and said semi-spherical cavity formed in said support cooperate to make said load wheel steerable and tiltable.

* * * * *